US006880769B2

(12) United States Patent
Coldren et al.

(10) Patent No.: US 6,880,769 B2
(45) Date of Patent: Apr. 19, 2005

(54) ELECTRONICALLY-CONTROLLED FUEL INJECTOR

(75) Inventors: Dana R. Coldren, Fairbury, IL (US); Glen F. Forck, Peoria, IL (US); L. Glenn Waterfield, Chillicothe, IL (US)

(73) Assignee: Caterpillar Inc, Peoria, IL (US)

( * ) Notice: Subject to any disclaimer, the term of this patent is extended or adjusted under 35 U.S.C. 154(b) by 105 days.

(21) Appl. No.: 10/319,861

(22) Filed: Dec. 13, 2002

(65) Prior Publication Data

US 2003/0127532 A1 Jul. 10, 2003

Related U.S. Application Data

(60) Provisional application No. 60/341,467, filed on Dec. 17, 2001.

(51) Int. Cl.[7] ..... F02M 59/00; F02M 39/00; B05B 1/30

(52) U.S. Cl. ..... 239/533.2; 239/533.3; 239/585.1; 239/585.5; 239/585.2; 239/102.2

(58) Field of Search ..... 239/533.2, 533.3, 239/533.8, 533.9, 585.1–585.5, 88–93, 102.2; 251/129.06, 129.15, 129.21; 310/12–14, 26, 317

(56) References Cited

U.S. PATENT DOCUMENTS

| | | | | |
|---|---|---|---|---|
| 4,175,587 A | | 11/1979 | Chadwick et al. | |
| 4,720,077 A | | 1/1988 | Minoura et al. | |
| 4,748,954 A | | 6/1988 | Igashira et al. | |
| 4,783,610 A | | 11/1988 | Asano | |
| 4,803,393 A | | 2/1989 | Takahashi | |
| 4,813,601 A | | 3/1989 | Schwerdt et al. | |
| 4,887,569 A | | 12/1989 | Igashira et al. | |
| 4,917,068 A | | 4/1990 | Takahashi et al. | |
| 4,927,084 A | | 5/1990 | Brandner et al. | |
| 4,966,119 A | * | 10/1990 | Mitsuyasu et al. | 123/498 |
| 5,035,360 A | | 7/1991 | Green et al. | |
| 5,203,537 A | | 4/1993 | Jacobs et al. | |
| 5,330,100 A | | 7/1994 | Malinowski | |
| 5,394,852 A | | 3/1995 | McAlister | |
| 5,477,834 A | | 12/1995 | Yoshizu | |
| 5,645,226 A | | 7/1997 | Bright | |
| 5,740,782 A | | 4/1998 | Lowi, Jr. | |
| 5,875,764 A | | 3/1999 | Kappel et al. | |
| 5,961,096 A | * | 10/1999 | Jalink et al. | 251/129.06 |
| 5,986,871 A | | 11/1999 | Forck et al. | |
| 6,156,145 A | * | 12/2000 | Clark | 156/160 |
| 6,394,073 B1 | * | 5/2002 | Binkele et al. | 123/506 |

FOREIGN PATENT DOCUMENTS

| | | | | |
|---|---|---|---|---|
| GB | 2338513 A | * | 12/1999 | F02M/61/20 |
| JP | 02003101093 A | * | 9/2001 | H02N/2/00 |

* cited by examiner

*Primary Examiner*—Davis Hwu
(74) *Attorney, Agent, or Firm*—Liell & McNeil; Kelsey L Milman

(57) ABSTRACT

An electronically-controlled fuel injector includes a pressurized fluid chamber that communicates high pressure fluid to first and second pressure control chambers. A direct-operated check moves between closed and open positions in response to a difference in fluid pressure in the first and second pressure control chambers. A thermally pre-stressed bender actuator is used to operate a control valve that controls the fluid pressure in the first pressure control chamber to effectively control opening and closing of the check during portions of an injection sequence.

20 Claims, 3 Drawing Sheets

ELECTRONICALLY-CONTROLLED FUEL INJECTOR

RELATION TO OTHER PATENT APPLICATION

This application claims the benefit of provisional patent application No. 60/341,467, filed Dec. 17, 2001 with the same title.

TECHNICAL FIELD

The present invention relates generally to fuel injector systems and, more particularly, to an electronically-controlled fuel injector.

BACKGROUND

Electronically-controlled fuel injectors are designed to inject precise amounts of fuel into an engine combustion chamber for combustion to generate motive power. The fuel injectors are connected to a fuel tank and include internal fluid chambers, fluid passages, and control valves that communicate fuel through the injector between injection events. During an injection sequence, the control valves move in a predetermined timing sequence to open and close the various fluid passages and fluid chambers so that pressurized fuel is injected into the combustion chamber at the appropriate time from an injection tip of the injector.

In prior fuel injectors, control valves within the injector have been actuated by one or more solenoids that receive control signals from an electronic control. In response to the control signals, the solenoids are operable to cause the control valves to move from one position to another so that fuel is communicated through the injector and to the injector tip in a desired manner. Compression springs may be used to move the control valves to a return position when the control signals are terminated.

In such solenoid-controlled injectors, it is often difficult to accurately control movement and positioning of the control valves through the control signals applied to the solenoids. This is especially true when intermediate positioning of a solenoid-controlled valve between two opposite, fixed positions is desired. Solenoid-controlled valves, by their very nature, are susceptible to variability in their operation due to inductive delays, eddy currents, spring pre-loads, solenoid force characteristics and varying fluid flow forces. Each of these factors must be considered and accounted for in a solenoid-controlled fuel injector design. Moreover, the response time of solenoids limits the minimum possible dwell times between multiple injection events and makes the fuel injector generally more susceptible to various sources of variability.

The present invention is directed to one or more of the problems set forth above.

SUMMARY OF THE INVENTION

While the invention is described in connection with certain embodiments, it will be understood that the invention is not limited to these embodiments. On the contrary, the invention includes all alternatives, modifications and equivalents as may be included within the spirit and scope of the present invention.

In one aspect, a fuel injector includes a spill control valve member and a needle control valve member at least partially positioned in an injector housing. An electroactive bender actuator is operably coupled to move the spill control valve member and a needle control valve member.

In another aspect, a valve assembly includes a plurality of valve members at least partially positioned in a housing that includes a plurality of valve seats. An electroactive bender actuator is attached to the housing and operably coupled to the plurality of valve members. The plurality of valve members have a first configuration with respect to the valve seats when the electroactive bender is at rest. The plurality valve members have a second configuration with respect to the valve seats when the electroactive bender is energized with a first voltage. Finally, the plurality of valve members have a third configuration with respect to the valve seats when the electroactive bender is energized with a second voltage that is greater in magnitude than the first voltage.

In still another aspect, a method of injecting fuel includes a step of closing a spill valve at least in part by changing a voltage applied to an electroactive bender actuator. A nozzle outlet is open at least in part by further changing a voltage applied to the electroactive bender actuator.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION

Figure 1:
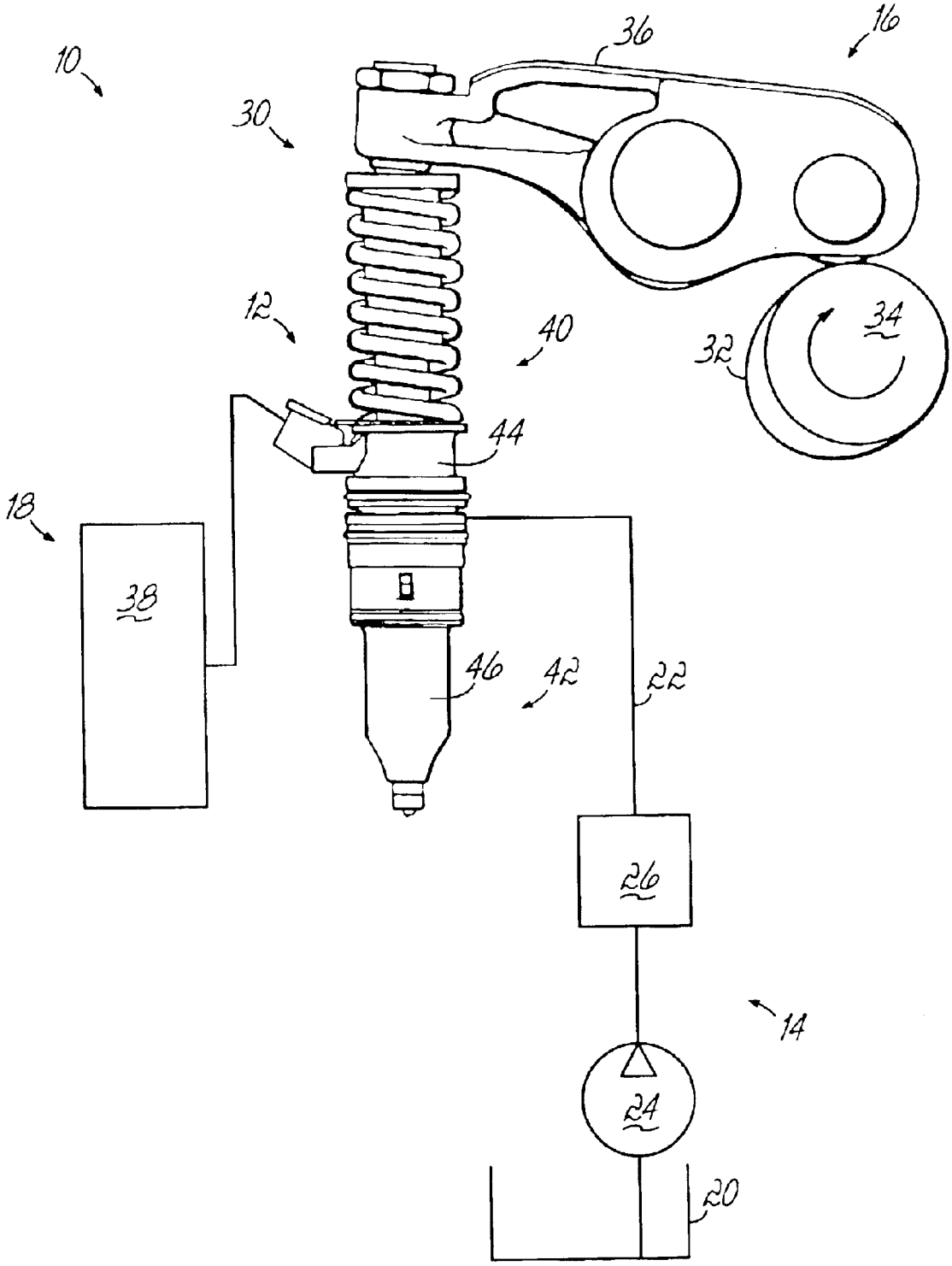
FIG. 1 is a diagrammatic view of an electronically-controlled fuel injector system in accordance with one embodiment of the present invention.

With reference to the Figures, and to FIG. 1 in particular, an exemplary embodiment of an electronically-controlled fuel system 10 for employing the present invention is shown. The exemplary fuel injection system 10 is adapted for a direct-injection diesel-cycle reciprocating internal combustion engine. However, it should be understood that the present invention is also applicable to other types of engines, such as rotary engines, or modified-cycle engines, and that the engine may contain one or more engine combustion chambers or cylinders. The engine typically has at least one cylinder head wherein each cylinder head defines one or more separate injector bores, each of which receives a fuel injector 12 in accordance with the one embodiment of the present invention.

The fuel system 10 further includes an apparatus 14 for supplying fuel to each injector 12, an apparatus 16 for causing each injector 12 to pressurize fuel, and an apparatus 18 for electronically controlling each injector 12.

The fuel supplying apparatus 14 typically includes a fuel tank 20, a fuel supply passage 22 arranged in fluid communication between the fuel tank 20 and the injector 12, a relatively low pressure fuel transfer pump 24, one or more fuel filters 26, and a fuel drain passage 28 arranged in fluid communication between the injector 12 and the fuel tank 20. If desired, the fuel passages may be disposed in the head of the engine in fluid communication with the fuel injector 12 and one or both of the passages 22 and 28.

The apparatus 16 may be any mechanically actuated device or hydraulically actuated device. In the illustrated operating environment, a tappet and plunger assembly 30 associated with the injector 12 is mechanically actuated indirectly or directly by a cam lobe 32 of an engine-driven cam shaft 34. The cam lobe 32 drives a pivoting rocker arm assembly 36 which in turn reciprocates the tappet and plunger assembly 30. Alternatively, a push rod (not shown) may be positioned between the cam lobe 32 and the rocker arm assembly 36 by ways known to those skilled in the art.

Those skilled in the art will appreciate that the cam or other means (e.g., hydraulic) for moving the plunger to pressurize fuel could be modified from that illustrated to cause any number of injections to occur anywhere in the engine cycle. For instance, an additional cam lobe could permit an early injection into the engine cylinder when the engine piston is closer to a bottom position than a top position, and then a later lobe could allow for injection at or around a top position in a conventional manner.

The electronic controlling apparatus 18 preferably includes an electronic control module (ECM) 38 which typically controls: (1) fuel injection timing and pressure; (2) total fuel injection quantity during an injection cycle; (3) the number of separate injection segments during each injection cycle, (4) the time interval(s) between the injection segments; and (5) the fuel quantity delivered during each injection segment of each injection cycle.

Figure 2:
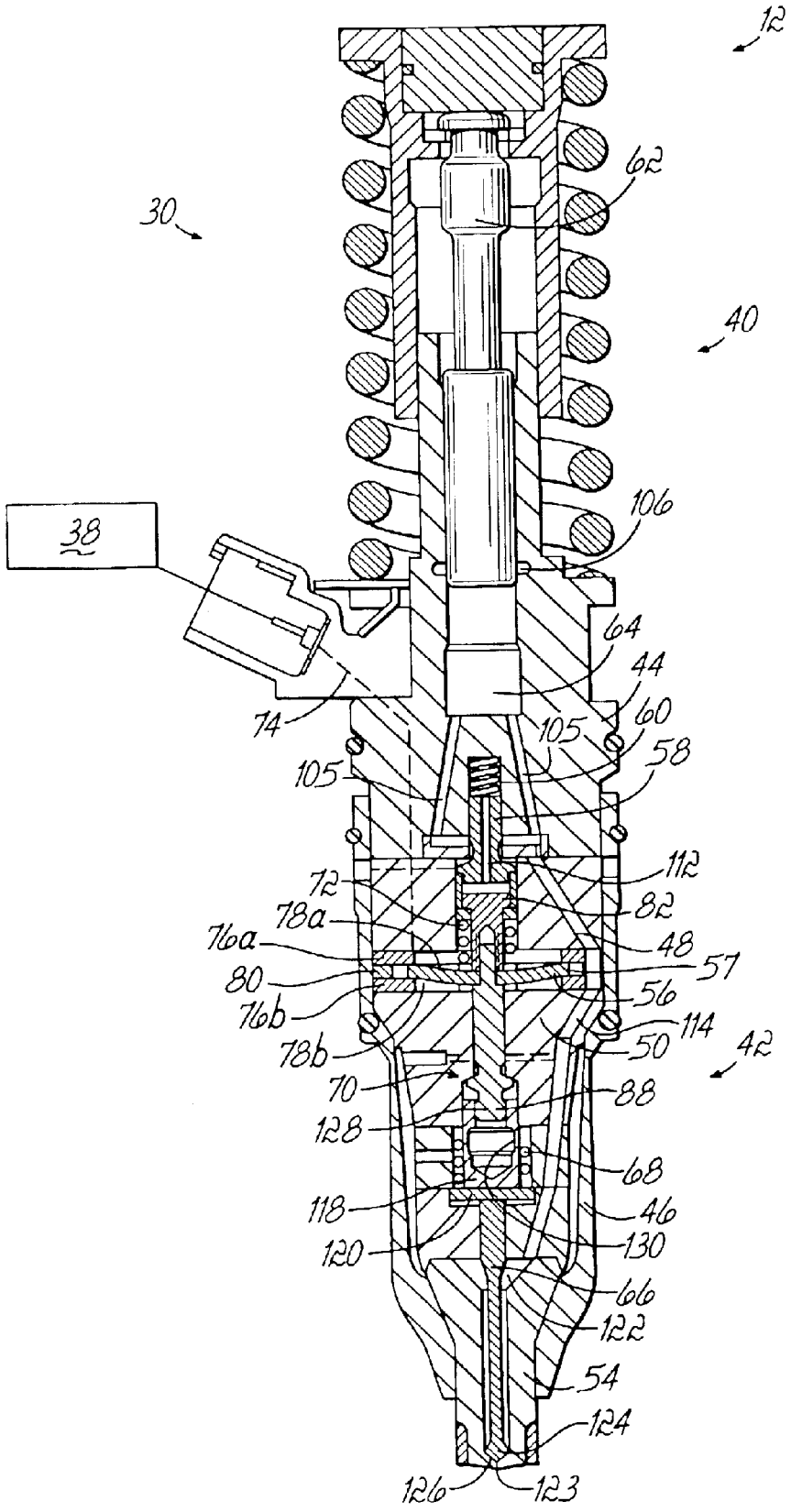
FIG. 2 is an enlarged diagrammatic cross-sectional view of the fuel injector shown in FIG. 1.

Each injector 12 is typically a unit injector wherein both a fuel pressurization portion 40 and a fuel injection portion, e.g., nozzle portion, 42 are housed in the same unit. In the illustrated embodiment, the fuel pressurization portion 40 includes a housing 44 for operatively supporting the tappet and plunger assembly 30. Referring to FIG. 2, the fuel injection portion 42 typically includes an outer casing 46 operatively coupled with the housing 44, an upper body 48, a lower valve body 50, and a tip member 54. Although shown as a unitized injector 12, the injector 12 could alternatively be of a modular construction wherein the fuel injection portion 40 is separate from the fuel pressurization portion 42, such as by using a unit pump for each nozzle portion.

The injector 12 includes an electrically-operated valve actuator 56, a high pressure spill valve or control valve 58, a high pressure spill valve spring 60, a plunger 62 disposed in a plunger cavity or fluid chamber 64, a needle valve 66, a check spring 68, a two-way direct operated check (DOC) or control valve 70 and a DOC valve spring 72. The high pressure spill valve spring 60 exerts a first spring force when compressed whereas the DOC valve spring 72, which is preferably assembled in a compressed state, exerts a second spring force, or pre-load, greater than the first spring force of high pressure spill valve spring 60.

In accordance with one embodiment of the present invention, valve actuator 56 comprises a thermally pre-stressed electroactive bender actuator 57 that changes its shape by deforming in opposite axial directions in response to a control signal applied by the ECM 38. The control signal may be, for example, a voltage signal applied from the ECM 38 to the valve actuator 56 though a pair of electrical conductors 74 (shown in phantom in FIG. 2). The bender actuator 57 typically has a cylindrical or disk configuration and includes at least one electroactive layer (not shown) positioned between a pair of electrodes (not shown), although other configurations are possible as well without departing from the spirit and scope of the present invention. In a de-energized or static state, the bender actuator 57 is typically thermally pre-stressed to have a domed configuration as shown in FIG. 2. When the electrodes are energized to place the bender actuator 57 in an actuated state, such as when a voltage control signal is applied by the ECM 38, the bender actuator 57 displaces axially by flattening out from the domed configuration, for example, although increased doming is also possible. Examples of thermally pre-stressed actuators 57 suitable for use in the present invention are described in U.S. Pat. Nos. 5,471,721 and 5,632,841. Valve actuator 56 may comprise a plurality of bender actuators (configured in parallel or in series) that are individually stacked or bonded together into a single multi-layered element.

In one embodiment of the invention, the valve actuator 56 is mounted between and supported by a pair of locking rings 76*a* and 76*b* (FIGS. 2 and 2A) that are each configured to clamp opposed major surfaces 78*a* and 78*b* (FIG. 2A), respectively, of the actuator 57. The locking rings 76*a*, 76*b* typically have a cylindrical configuration and are disposed in a cavity between the upper body 48 and the lower valve body 50. A cylindrical spacer ring 80 (FIG. 2A) surrounds the peripheral edge of the bender actuator 56 and has an inner diameter that is slightly greater than the outer diameter of the bender actuator 57 to accommodate for radial displacement of the actuator 57 in response to the control signal.

Figure 2A:
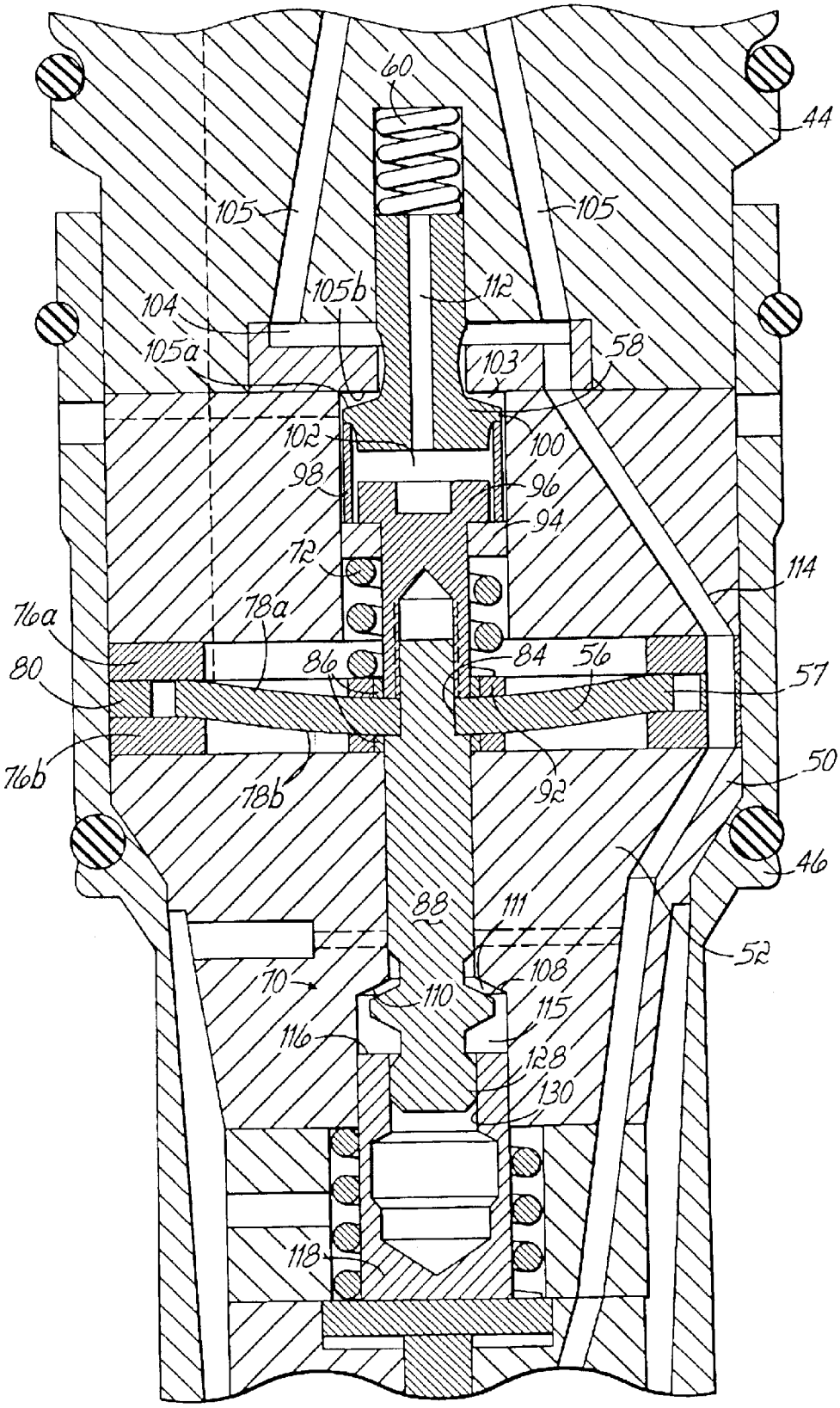
FIG. 2A is an enlarged diagrammatic view of the valve assembly portion of the fuel injector shown in FIG. 2.

As shown in FIGS. 2 and 2A, a cylindrical member 82 extends through a bore 84 (FIG. 2A) formed through the bender actuator 57 and may be fixed to the actuator 57 through a pair of locking collars 86 (FIG. 2A) that contact the surfaces 78*a*, 78*b* of the actuator 57. Alternatively, they may be threaded, welded, glued or otherwise fastened to the cylindrical member 82. One end of the cylindrical member 82 is operatively connected to a valve stem or poppet 88 of the DOC valve 70 through a fastener, direct threaded engagement or any other suitable means of attachment.

The DOC valve spring 72 is placed in compression between a washer 92 of bender actuator 57 and a washer 94 (FIG. 2A) that abuts a shoulder portion 96 of the cylindrical member 82. A cylindrical spill valve spacer 98 is disposed between the washer 94 and a shoulder portion 100 (FIG. 2A) of the spill valve 58. The washer 94 may be axially slidable over the cylindrical member 82 for reasons explained hereinafter.

At the end of an injection event, the electroactive bender actuator 57 may be de-energized, thereby permitting the spill valve spring 60 to open the high pressure spill valve 58. Fuel circulates from the transfer pump 24 (FIG. 1) and the fuel supply passage 22 into internal passages (not shown) of the fuel injector 12 which connect with space 104 through a fluid passage 103 (FIG. 2A) of the open high pressure spill valve 58 and thereafter through one or more additional passages 105 to the plunger cavity or fluid chamber 64. When the plunger 62 is retracted to the full upward position, due to a spring and position of the cam lobe 32 with respect to the apparatus 16, fuel is conducted to an annular recess 106 surrounding the plunger 62, which is in turn coupled in fluid communication with the drain passage 28 (FIG. 1). The fuel thus recirculates through the injector 12 during non-injection portions of each engine cycle for the purpose of cooling and to fill the plunger chamber 64.

Also at this time, the DOC needle control valve 88 is disposed in an open position in which a sealing surface 108 of the needle control valve 88 is spaced away from a valve seat 110 defined by the lower valve body 52 to create a fluid passage 111 (FIG. 2A).

During a portion of an injection sequence to accomplish fuel injection, a control signal, e.g., a voltage signal of a first magnitude, is applied from the ECM 38 to the bender actuator 57 to cause the actuator 57 to displace a first distance toward the high pressure spill valve 58. The magnitude of the control signal is sufficient to cause the bender actuator 57 to exert a force during its partial axial displacement that exceeds the first spring force exerted by the high pressure spill valve spring 60 but less than the second spring force exerted by the DOC valve spring 72. The force generated by the bender actuator 57 is transmitted through the DOC valve spring 72, the DOC washer 94 and the cylindrical spill valve spacer 98 to close the fluid passage 103 (FIG. 2A) of spill valve 58. In the closed position of spill valve 58, a sealing surface 105*a* (FIG. 2A) of the shoulder portion 100 contacts a seat 105*b* (FIG. 2A)of the housing 44 to close fluid passage 103. Movement of the high pressure spill valve 58 may be damped by fluid flowing through a dampening orifice 112 extending axially through the high pressure spill valve 58. The force exerted by the bender actuator 57 is insufficient to substantially compress the DOC valve spring 72.

Further, during this interval, the needle control valve 88 moves upwardly with displacement of the bender actuator 57 due its connection to the bender actuator 57. As the bender actuator 57 flattens out from its domed configuration, the needle control valve 88 moves upwardly. However, the amount of this travel from the fully opened position of the needle control valve 88 is insufficient to cause the sealing surface 108 to contact the seat 110, and therefore the DOC valve 70 remains open.

Subsequently, fuel is pressurized by downward movement of the plunger 62 in the plunger cavity 64. The pressurized fuel is conducted through a high pressure fuel passage 114, and also through fluid passage 111 between the sealing surface 108 and seat 110 via a cross drilled hole (not shown), to a first pressure control chamber 115 (FIG. 2A) and against an upper surface 116 (FIG. 2A) of a DOC piston 118. The DOC piston 118 in turn bears against a spacer 120 which abuts a top end of the needle valve 66. The fuel passage 114 further conveys pressurized fluid to a check passage or second pressure control chamber 122. Accordingly, the fluid pressures across the needle valve 66 are substantially balanced and thus the check spring 68 keeps the needle valve 66 in the closed position such that a check tip 124 bears against a seat 126 of the tip member 54 to close dispensing orifice 123.

During an injection, the control signal is changed, such as to have a higher magnitude voltage signal, and is applied by the ECM 38 to the valve actuator 56 to cause the bender actuator 57 to further flatten out or deform in the axial direction. This further displacement of the bender actuator 57 moves the needle control valve 88 against the force of the DOC valve spring 72, thereby causing the sealing surface 108 to contact the seat 110 to close fluid passage 111. During this movement, the cylindrical member 82 moves axially upward within the washer 94 so that an overtravel characteristic is obtained. Fluid captured in the first pressure control chamber 115 above the upper surface 116 of the DOC piston 118 bleeds via a controlled leakage path between a head portion 128 (FIG. 2A) of the needle control valve 88 and a wall 130 (FIG. 2A) of the DOC piston 118 and through a passage (not shown) extending through the side walls of the DOC piston 118 to drain. A low pressure zone is thereby established in the first pressure control chamber 115 above the DOC piston 118, thereby causing the needle valve 66 to move upwardly to initiate fuel injection through the injection orifice 123 as a result of the difference in fluid pressure in the first and second pressure control chambers 115, 122. Movement upward by the needle valve 66 thereby allows fuel to exit the injector 12 via the injection orifice 123, and enter a combustion chamber (not shown).

When injection is to be terminated, the control signal applied to the bender actuator 57 may be reduced to the first magnitude, be reduced to zero, or be applied to the actuator 57 in an opposite polarity. In any case, the reduced or reversed control signal allows the bender actuator 57 to return towards its static domed configuration, thereby moving the needle control valve 88 downward to open the fluid passage 111 between the sealing surface 108 and seat 110 whereby fluid communication is again established between the fuel passage 114 and the first pressure control chamber 115 above the upper surface 116 of the DOC piston 118.

The application of high fuel pressure to the top of the DOC piston 118 and the force exerted by check spring 68 cause the needle valve 66 to move downwardly such that the check tip 124 engages the seat 126 to close injection orifice 123, thereby preventing further fuel injection. Downward movement of the needle control valve 88 also permits the high pressure spill valve spring 60 to open the high pressure spill valve 58 and fluid passage 103. Fuel then circulates through the high pressure spill valve 58, the chamber 102 and space 104, the plunger cavity 64, and the annular recess 106 to drain for cooling purposes as described above.

Industrial Applicability

The thermally pre-stressed bender actuator 57 of the present invention may provide rapid, accurate, and repeatable controlled movement of the DOC poppet valve 88 between its open, partially open and closed positions. The bender actuator 57 of the present invention is a generally lightweight, proportional device having a stroke output that is proportional to the input control signal. Accurate, repeatable bi-directional movement of the DOC poppet valve 88 is controlled simply by varying the magnitude and polarity of the control signal applied to the actuator 56. Further, the bender actuator 57 of the present invention has a fast response time so that dwell time between multiple injection events can be reduced, thereby also reducing variability from injection event to injection event. Additionally, thermally pre-stressed bender actuator 57 acts as a capacitive load and will remain in its actuated position for a period of time after the ECM control signal is terminated unlike a solenoid that requires a continuous voltage signal and a current source during its actuation phase. Therefore, the fuel injector 12 of the present invention may be generally lighter and requires less power for operation than solenoid-controlled fuel injectors of the past.

Although the present invention has been illustrated in FIG. 1 as including a cam with a single lobe, those skilled in the art will appreciate that a cam having any number of lobes could be substituted in its place so that a plurality of spaced apart injection events could be performed by the fuel injector. For instance, it might be desirable to have at least two cam lobes separated substantially and angled such that one or more early injections can take place when the engine piston is closer to its bottom position than its top position. These injections are often referred to as homogenous charge injection events because the fuel and air have ample time to mix before ignition occurs near piston top dead center position. In addition, those skilled in the art will appreciate that a plurality of closely spaced injection events can be accomplished by dropping the voltage to the electroactive bender to a voltage level that reopens seat 110 while seat 105*d* remains closed to briefly stop an injection event. After some predetermined dwell, the voltage applied to the electroactive bender can be raised again to close seat 110 and commence another injection event. Because of the quick action of the electroactive bender, the fuel injector of the present invention has the ability to inject extremely small amounts in each injection event and separate injection events by relatively brief periods of time. If a longer dwell between injection events is desired, the voltage to the electroactive bender can be dropped sufficiently far that the spill valve reopens between injection events. Thus, those skilled in the art will appreciate that the fuel injector of the present invention can be operated in a way to produce any number of injection events, at a variety of desired timings and separated by relatively brief durations. In addition, these injection events can inject relatively small or large quantities of fuel to produce a wide variety of affects, including reduction in undesirable emissions from the engine.

In addition to having the ability to produce multiple injection events in a given engine cycle, the present invention also has the ability to do some front end rate shaping. This is accomplished via a relative timing as to when the spill control and needle control valve members are moved to their closed positions. For instance, if an injection event is initiated by raising the voltage to the actuator sufficiently to move both valve members to their closed positions, the spray of fuel will commence when fuel pressure exceeds a valve opening pressure determined by the biasing spring on the needle valve member. Thereafter, the fuel injection pressure will ramp up to its maximum via either a ramp shape and/or boot shape. In another extreme example, the voltage necessary to close the needle control valve can be applied after the fuel has achieved high injection pressure levels so that injection initially occurs at a relatively high injection pressure. This injection profile is often referred to as a square front end rate shape. The front end rate shaping can also vary between these two extremes via the relative timing of when the voltage is raised to a level necessary to close the needle control valve member.

Although the present invention has been illustrated and described as having the spill control valve open when the electroactive bender is un-energized, those skilled in the art will appreciate that the fuel injector of the present invention could have an alternative construction. For instance, the spill control valve could be closed when the electroactive bender is in its rest state. In such a case, a negative voltage of some pre-determined magnitude would be applied at the beginning of the plunger stroke in order to open the spill control valve. At a time when it is desired to pressurize the fuel, the voltage to the electroactive bender would be ceased, allowing the spill control valve to return to its normally closed position. At some desired timing for a fuel injection, a positive voltage would be applied to the electroactive bender to close valve seat 110 to allow an injection event to commence.

In addition, although the present invention has been illustrated as including unit injectors that have both the fuel pressurization and a nozzle portion in one injector housing, those skilled in the art will appreciate that the nozzle portions could be separated from the fuel pressurization portions and placed in separate housing. For instance, the fuel pressurization portions of the fuel injector illustrated could be replaced with separated unit pumps. In addition, the plunger of the present invention could be driven downward hydraulically rather than mechanically as illustrated. In addition, a combined hydraulic and mechanical strategy could be employed for moving the plungers downward to the pressurized fuel.

Although the present invention has been illustrated in the context of a fuel injector, the valve assembly could potentially find other applications, especially in those instances where control over fluid flow is accomplished via a combination of fluid pressure and electronic control. The valve assembly of the present invention includes a single electroactive bender actuator that is operably coupled to two valve members. These two valve members are a spill control valve member and the needle control valve member in the illustrated embodiment. When the electroactive bender is at rest, the valve assembly has a first configuration, which in the illustrated embodiment has both valve members in their open positions. When a voltage of a first magnitude is applied, the valve assembly assumes a second configuration, which in the illustrated embodiment is the spill control valve member in its closed position while the needle control valve member remains in a partially open position. When still a higher magnitude voltage is applied to the electroactive bender actuator, the valve assembly assumes a third configuration, where both the needle control valve member and the spill control valve member are in their closed positions. Depending upon what type of task one wishes to accomplish in controlling the flow of a fluid, the valve assembly of the present invention could be a potential candidate, although it finds its preferred application in fuel injectors.

While the present invention has been illustrated by a description of various embodiments, and while these embodiments have been described in considerable detail, it is not the intention to restrict or in any way limit the scope of the appended claims to such detail. Additional advantages and modifications will readily appear to those skilled in the art. For example, separate elements may be integrated into a single component and vice versa, functional aspects may be reversed such as whether fluid pressure is applied/restored so as to cause a particular result, etc. The invention in its broader aspects is, therefore, not limited to the specific details, representative apparatus and method, and illustrative example shown and described. Accordingly, departures may be made from such details without departing from the spirit or scope of the invention.

What is claimed is:

1. A fuel injector comprising:

an injector housing;

a spill control valve member at least partially positioned, and being movable along a line, in said injector housing;

a needle control valve member at least partially positioned, and being movable alone a line, in said injector housing; and an electroactive bender actuator operably coupled to move said spill control valve member and said needle control valve member, and the electroactive bender actuator having a domed shaped portion when in a de-energized state.

2. The fuel injector of claim 1 including a plunger at least partially positioned in said injector housing.

3. The fuel injector of claim 2 including a tappet assembly operably coupled to said plunger.

4. The fuel injector of claim 1 wherein said electroactive bender actuator includes a thermally prestressed bender disk that includes the dome shaped portion.

5. The fuel injector of claim 1 including a peripheral clamp that is clamped around a peripheral edge of said electroactive bender actuator.

6. The fuel injector of claim 1 including a needle valve with an upper surface exposed to fluid pressure in a pressure control chamber;

a high pressure fuel passage disposed in said injector housing; and said pressure control chamber being fluidly connected to said high pressure fuel passage when said needle control valve is in an open position.

7. The fuel injector of claim 6 including a drain disposed in said injector housing; and said needle control chamber being fluidly connected to said drain via a leakage path when said needle control valve is in said open position.

8. The fuel injector of claim 1 wherein said electroactive bender actuator is positioned between said needle control valve member and said spill control valve member along a centerline of said injector housing.

9. The fuel injector of claim 1 wherein said electroactive bender actuator moves said spill control valve member to a closed position at a first voltage; and said electroactive bender actuator moves said needle control valve member to a closed position at a second voltage that is greater in magnitude than said first voltage.

10. A valve assembly comprising:

a housing including a plurality of valve seats;

a plurality of valve members at least partially positioned in said housing;

an electroactive bender actuator attached to said housing and operably coupled to said plurality of valve members, and the electroactive bender actuator having a domed shaped portion when in a de-energized state at rest;

said plurality of valve members having a first configuration with respect to said valve seats when said electroactive bender is at rest;

said plurality of valve members having a second configuration with respect to said valve seats when said electroactive bender is energized with a first voltage;

said plurality of valve members having a third configuration with respect to said valve seats when said electroactive bender is energized with a second voltage that is greater in magnitude than said first voltage; and said plurality of valve members move along a line between the first, second and third configurations.

11. The valve assembly of claim 10 wherein said plurality of valve members includes a first valve member and a second valve member;

said plurality of valve seats includes a first valve seat and a second valve seat;

said first valve member being out of contact with said first seat, and said second valve member being out of contact with said second valve seat in said first configuration;

said first valve member being in contact with said first valve seat in said second configuration; and said second valve member being in contact with said second valve seat in said third configuration.

12. The valve assembly of claim 11 including a fluid passage disposed in said housing;

said fluid passage being fluidly connected to a drain past said first valve seat and said second valve seat when in said first configuration;

said fluid passage being closed to said drain in said third configuration.

13. The valve assembly of claim 12 wherein said fluid passage is fluidly connected to said drain via a leakage path in said second configuration.

14. The valve assembly of claim 13 wherein said fluid passage is fluidly connected to a fluid source at one end, and fluidly connected to an outlet at an opposite end;

a needle valve at least partially positioned in said housing, and having a first position in which said outlet is closed, and a second position in which said outlet is open.

15. The valve assembly of claim 14 including a pressure control chamber disposed in said housing;

said needle valve having a closing hydraulic surface exposed to fluid pressure in said pressure control chamber; and said pressure control chamber being separated from said fluid passage by said second valve seat.

16. A method of injecting fuel, comprising the steps of:

closing a spill valve at least in part by changing a voltage applied to an electroactive bender actuator to flatten a domed shape portion thereof; and opening a nozzle outlet at least in part by further changing a voltage applied to the electroactive bender actuator to further flatten the domed shape portion.

17. The method of claim 16 wherein said closing step is accomplished at least in part by applying a first voltage to the electroactive bender; and said opening step is accomplished at least in part by applying a second voltage, which is greater in magnitude than the first voltage, to the electroactive bender.

18. The method of claim 16 including a step of closing the nozzle outlet; and the steps of opening and closing the nozzle outlet are performed a plurality of times in a single engine cycle.

19. The method of claim 16 wherein the opening and closing steps are performed in an engine cylinder with a piston closer to a bottom position than a top position.

20. The method of claim 16 including a step of closing the nozzle outlet at least in part by exposing a closing hydraulic surface of a needle valve to high pressure fuel.

* * * * *

UNITED STATES PATENT AND TRADEMARK OFFICE

CERTIFICATE OF CORRECTION

PATENT NO. : 6,880,769 B2
DATED : April 19, 2005
INVENTOR(S) : Dana R. Coldren et al.

It is certified that error appears in the above-identified patent and that said Letters Patent is hereby corrected as shown below:

Column 8,
Line 45, delete "alone" and insert -- along --

Signed and Sealed this

Twelfth Day of July, 2005

JON W. DUDAS
*Director of the United States Patent and Trademark Office*